US005341933A

United States Patent [19]

Willows

[11] Patent Number: 5,341,933

[45] Date of Patent: Aug. 30, 1994

[54] DISPENSING DEVICE

[75] Inventor: Barry L. Willows, Cape Town, South Africa

[73] Assignee: Roger C. Kriel, Cape Province, South Africa

[21] Appl. No.: 16,944

[22] Filed: Feb. 12, 1993

[30] Foreign Application Priority Data

Feb. 12, 1992 [ZA] South Africa ..... 92/1019

[51] Int. Cl.[5] ..... B65D 33/28

[52] U.S. Cl. ..... 206/554; 383/41; 383/43; 383/67; 383/75; 221/DIG. 1

[58] Field of Search ..... 383/41, 43, 67, 71, 383/72, 75, 906; 150/154, 160, 161, 162; 221/DIG. 1; 206/554

[56] References Cited

U.S. PATENT DOCUMENTS

| | | | |
|---|---|---|---|
| 2,035,384 | 3/1936 | Hinchliff | 150/154 X |
| 2,530,250 | 11/1950 | Leith | 383/41 X |
| 2,751,952 | 6/1956 | Mirus | 383/41 |
| 3,737,171 | 6/1973 | Becker | 150/154 |
| 3,766,954 | 10/1973 | Gentellalli | 150/154 |
| 4,785,934 | 11/1988 | Hogle | 383/67 X |
| 4,957,246 | 9/1990 | Kantor | 150/154 X |
| 5,133,607 | 7/1992 | Bonke | 383/72 X |

FOREIGN PATENT DOCUMENTS

| | | | |
|---|---|---|---|
| 0541519 | 8/1959 | Belgium | 383/75 |
| 1009624 | 6/1952 | France | 383/41 |
| 1495236 | 7/1989 | U.S.S.R. | 383/43 |

*Primary Examiner*—Allan N. Shoap
*Assistant Examiner*—Jes F. Pascua
*Attorney, Agent, or Firm*—Ladas & Parry

[57] ABSTRACT

A storage and dispensing device for storing plastic shopping bags and holding them ready for retrieval, comprises a tube 12 of cloth fabric having an entry opening 14 at the top and a dispensing opening 16 at the bottom. The tube has a drawstring 18 around the entry opening and an elastic band 20 sewn in a hem around the dispensing opening.

8 Claims, 1 Drawing Sheet

DISPENSING DEVICE

FIELD OF THE INVENTION

THIS INVENTION relates to a dispensing device. More particularly, it relates to a dispensing device for storing, and holding for ready retrieval, articles of flexible sheet material such as, for example, plastic shopping bags.

SUMMARY OF THE INVENTION

According to the invention there is provided storage and dispensing device for storing, and holding ready for retrieval, articles of flexible sheet material, the device comprising a bag of flexible sheet material having an entry opening at the top for insertion of said articles into the bag, and a dispensing opening at the bottom for withdrawal of said articles from the bag, the bag being elastically stretchable around the dispensing opening.

The bag may be in the form of an open-ended tube of cloth fabric, the upper end of the tube forming the entry opening, and the lower end of the tube forming the dispensing opening.

The bag may be rendered elastically stretchable around the dispensing opening by having an elastic band sewn into a hem of the bag around the dispensing opening.

The bag may have a drawstring at the top, around the entry opening, for use in closing the entry opening and/or suspending the device.

BRIEF DESCRIPTION OF THE DRAWINGS

The invention will now be described in more detail, by way of example, with reference to the accompanying drawings.

In the drawings.

DETAILED DESCRIPTION OF PREFERRED EMBODIMENT

Figure 1:
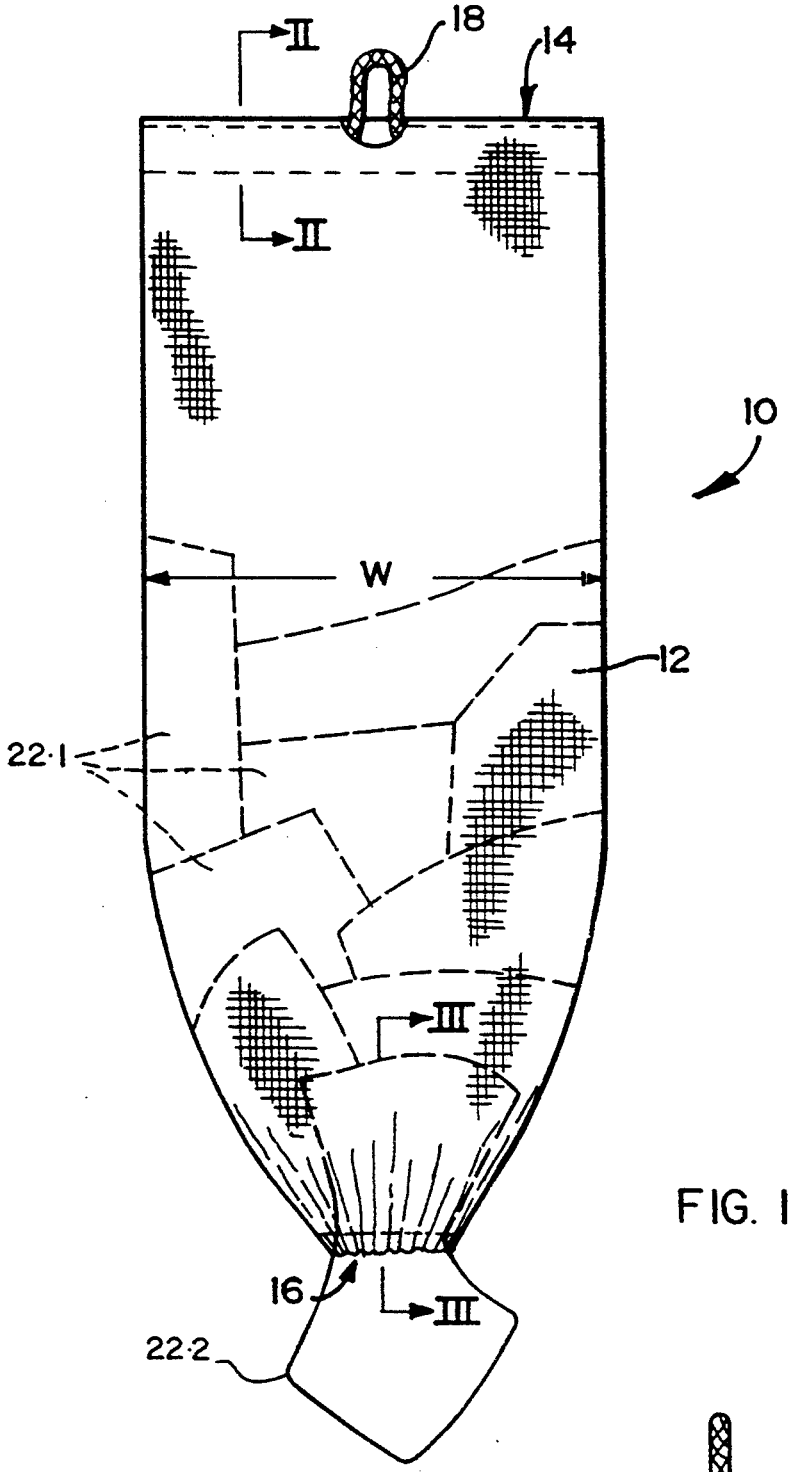
FIG. 1 is a side elevation of a dispensing device in accordance with the invention.
Figure 2:
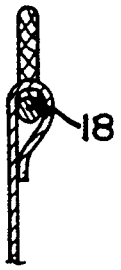
FIG. 2 is a detail section on line II—II in FIG. 1.
Figure 3:
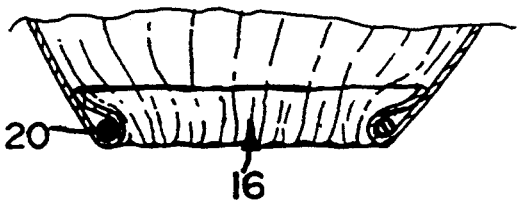
FIG. 3 is a detail section on line III—III in FIG. 1.

Referring now to the drawings in more detail, reference numeral 10 generally indicates a dispensing device for storing plastic shopping bags and holding them for ready retrieval. The device comprises a bag 12 which is the form of a tube of cloth fabric, the upper end of the tube forming an entry opening 14, and the lower end of the tube forming a dispensing opening 16.

The bag 12 is provided with a drawstring 18 around the entry opening 14, whereby the entry opening can be closed and whereby the device can be suspended.

An elastic band 20 is sewn into a hem of the bag 12 around the dispensing opening 16. The elastic band 20 contracts the lower end of the bag to a reduced diameter.

In a preferred embodiment of the invention, the bag 12 has a length of about 60 cm and a width W then in the lay-flat condition, of about 30 cm. The discharge opening 16 may have a diameter of about 2,5 cm when the elastic band 20 is in the contracted condition, and can be stretched to have a diameter of about 8 cm.

In use, used plastic shopping bags such as the ones shown at 22.1 in FIG. 1 are inserted into the bag via the entry opening 14. The bags can be inserted at random. When a bag is needed again, one is withdrawn from the device 10 by pulling it out through the dispensing opening 16 as shown at 22.2.

The device 10 enables old plastic shopping bags to be stored in a neat and tidy manner and enables them readily to be retrieved for re-use.

What I claim is:

1. A combination of a storage and dispensing device having plastic bags therein, comprising:

a dispensing device comprising an open-ended tube of flexible sheet material having an entry opening at the top for insertion of said plastic bags into the tube, and a dispensing opening at the bottom of said tube for withdrawal of said plastic bags, the tube being elastically stretchable around the dispensing opening; and a plurality of plastic bags stuffed into the entry opening of the tube whereby the bags can be held within the tube and eventually an individual bag can be withdrawn from the dispensing opening.

2. The combination according to claim 1 wherein the open-ended tube is of cloth fabric.

3. The combination according to claim 1, wherein the tube is rendered elastically stretchable around the dispensing opening by having an elastic band sewn into a hem of the tube around the dispensing opening.

4. The combination according to claim 3, wherein the tube has a draw string at the top, around the entry opening, for use in closing the entry opening.

5. The combination according to claim 4, wherein the open-ended tube is of cloth fabric.

6. The combination according to claim 1, wherein the tube has a draw string at the top, around the entry opening, for use in closing the entry opening.

7. The combination according to claim 1, wherein the entry opening is of sufficient width to facilitate insertion of the plastic bags into said tube.

8. The combination according to claim 7, wherein the dispensing opening is of sufficient width and elasticity to facilitate withdrawal of the plastic bags from said tube.

* * * * *